US005535978A

United States Patent [19]

Rodriguez et al.

[11] Patent Number: 5,535,978

[45] Date of Patent: Jul. 16, 1996

[54] BEACH UMBRELLA ANCHORING APPARATUS

[76] Inventors: Arturo E. Rodriguez, 15600 NW. 83rd Pl., Miami Lakes, Fla. 33016; Guillermo P. Rodriquez, 10121 NW. 24th Ct., Pembrook Pines, Fla. 33026

[21] Appl. No.: 273,883

[22] Filed: Jul. 12, 1994

[51] Int. Cl.[6] ..... E02D 5/74

[52] U.S. Cl. ..... 248/530; 248/532; 248/523; 248/507; 135/16; 135/118

[58] Field of Search ..... 248/530, 156, 248/545, 551, 523, 519, 507, 532, 533; 135/161, 118, 15.1

[56] References Cited

U.S. PATENT DOCUMENTS

| | | | |
|---|---|---|---|
| 473,016 | 4/1892 | Pattee | 248/532 X |
| 1,577,612 | 3/1926 | Dees | 248/532 |
| 2,759,486 | 8/1956 | Pesaturo | 135/16 |
| 3,339,869 | 9/1967 | Andersen | 248/532 |
| 4,131,122 | 12/1978 | Brooks | 248/532 X |
| 4,320,886 | 3/1982 | Stodala | 248/523 |
| 4,649,678 | 3/1987 | Lamson | 248/530 X |
| 4,753,411 | 6/1988 | Lechner et al. | 248/533 |
| 4,801,121 | 1/1989 | Zunker | 248/551 |
| 4,832,304 | 5/1989 | Morgulis | 248/156 X |
| 4,927,118 | 5/1990 | Pierorazio | 248/156 X |
| 5,046,699 | 9/1991 | Perreault et al. | 135/16 X |
| 5,101,525 | 4/1992 | Ippolito | 135/118 X |
| 5,122,014 | 6/1992 | Genfan | 248/156 X |
| 5,207,406 | 5/1993 | Stine et al. | 248/519 X |
| 5,271,196 | 12/1993 | Fanti . | |
| 5,354,031 | 10/1994 | Bilotti | 248/519 |

FOREIGN PATENT DOCUMENTS

| | | | |
|---|---|---|---|
| 0082583 | 10/1953 | Netherlands | 248/519 |

*Primary Examiner*—Wynn E. Wood
*Attorney, Agent, or Firm*—McHale & Slavin

[57] ABSTRACT

The present invention is an apparatus and method for anchoring the central support pole of a beach umbrella in the sand at a beach. The present anchoring apparatus includes a length of tube having a lower edge forming an opening at its lower end and a clamping means at its other end. The other or upper end of the tube is operatively adapted to permit the lower end of a beach umbrella support pole to be inserted there through, and the clamping means is suitable to lock in place the lower end of a support pole so inserted. The edge at the lower end of the tube is preferably serrated and intended to cut into the sand beach. The clamping means may include a threaded hole formed through the wall at the upper end of the tube and a screw that can be hand tightened through the threaded hole to apply a clamping force against the lower end of an umbrella support pole inserted into the upper end of the tube.

11 Claims, 2 Drawing Sheets

BEACH UMBRELLA ANCHORING APPARATUS

FIELD OF THE INVENTION

The present invention relates to beach umbrellas, and more particularly, to an apparatus for anchoring a conventional beach umbrella in a sand beach.

BACKGROUND OF THE INVENTION

Beach umbrellas have become synonymous with suntan lotion as a means for protecting beach goers from exposure to sunlight. It is well known that excessive exposure to sunlight may lead to skin cancer. For this reason, most astute beach goers seek shelter from the direct rays of the sun during the hottest part of the day using an umbrella which allows them to continue enjoying their visit. Suntan lotion, commonly used by sunbathers to block the sun, requires application to all exposed parts of the body. However, suntan lotion leaves many uncertainties including proper application, amount of sunblock protection, whether the lotion is still effective after exposure to water, allergic skin reaction, and carcinogenic ingredients.

Thus, beach umbrellas are becoming more and more popular as the beach goer becomes aware of dangers of both sunlight and suntan lotion use. The beach umbrella provides a portable shelter from the sun making the beach an enjoyable visit even to those not interested in sunbathing. The shade provided by the umbrella also keeps pets, picnic lunches, drinks and the like from getting overheated from direct sunlight exposure. Further, the umbrella can be used as a shelter from blowing wind and sand making most any visit to the beach an enjoyable experience.

A problem with beach umbrellas is directed to the anchoring of the umbrella. Unless securely fastened into the sand, the umbrella can easily tip over or be blown down the beach where it may cause injury to other beach goers. This is especially true of beach umbrellas having a support pole with a sharp tip, used for insertion into the sand, which may spear a hapless sunbather. Further, a pointed end on the umbrella support pole may cause injury during the placement process or even while being carried.

One type of beach umbrella known in the prior art utilizes a central support pole with a pointed lower end that is inserted directly into the sand. The pointed end is jammed into the sand and rocked back and forth until suitably embedded to maintain the support pole in a vertical or angled orientation. However, this type of installation loosens the surrounding sand so that a gust of wind can cause the umbrella to dislodge leading to the aforementioned dangerous conditions.

In an effort to prevent the beach umbrella from being pulled out of the sand, alternative techniques for better anchoring the support pole have been developed. One technique involves excavating a hole deep into the beach sand, inserting the support pole into the hole and using the excavated sand to fill-in the hole around the pole. A drawback to this technique is the relatively excessive amount of time it takes to excavate a hole of sufficient depth. A shovel or similar tool used to facilitate the digging further necessitates another device that must be carried to the beach.

The beach umbrella disclosed in U.S. Pat. No. 5,271,196 includes a baseplate mounted to the lower end of the support pole available for use as a digging tool in addition to anchoring the umbrella in the sand. The baseplate is bolted or otherwise threaded to the lower end of a two-piece pipe which functions as the central support pole for the umbrella. The lower piece of pipe mounting the baseplate is then detached from the umbrella and used to dig a hole in which the lower end of the support pole is buried. A disadvantage of this beach umbrella is that the hole dug must be relatively large in order to accommodate the baseplate and properly anchor the umbrella. In addition, this baseplate can only be mounted to the lower end the particular umbrella support pole disclosed and not to the lower end of conventional umbrella support pole.

Digging a large hole for placement of an umbrella base is illegal on some beaches. If the beach is used for turtle nesting, the digging may damage turtle eggs. Excavation of large holes is also likely to uncover rocks that, if left half buried under the sand, will cause injury to those walking barefoot. Finally, inconsiderate persons who must excavate the hole to remove the umbrella stand may leave the hole open wherein people can trip if gone unnoticed.

Thus, what is needed in the art is a beach umbrella and apparatus for securely anchoring the umbrella into the sand with minimal excavation.

SUMMARY OF THE INVENTION

One objective of the present invention is to securely anchor a conventional beach umbrella in the sand, thereby preventing the umbrella from being dislodged and blown across the surface of the beach.

Another objective of the present invention is to provide an apparatus and method for rapidly anchoring the support pole of a beach umbrella by reducing the degree of excavation of sand at the anchoring site.

An additional objective of the present invention is to provide an apparatus and method for anchoring the central support pole of a conventional or nonconventional type of beach umbrella.

The above and other objectives of the present invention are obtained by providing an apparatus and method for anchoring the central support pole of a beach umbrella in a sand beach. The present anchoring apparatus includes a tube having a lower edge forming an opening at its lower end and a clamping means at its other end. The other or upper end of the tube is operatively adapted to permit the lower end of a beach umbrella support pole to be inserted therethrough, and the clamping means is suitable to lock in place the lower end of a support pole so inserted. The edge at the lower end of the tube is preferably serrated and intended to cut into the sand beach. The clamping means may include a threaded hole formed through the wall at the upper end of the tube and a screw that can be hand tightened through the threaded hole to apply a clamping force against the lower end of an umbrella support pole inserted into the upper end of the tube.

In one feature of the present anchoring apparatus, at least one integral tie bracket is mounted at the upper end of the tube. With the tube embedded in the sand as described below, a bag containing personal property is secured to the tie bracket, such as with a string, and the bag covered with sand. In this way, the contents of the bag are hidden from the view of strangers and yet easily located and recoverable by their owner.

Installing the present anchoring apparatus involves brushing aside a small area of dry sand to expose the damp sand beneath. The lower end of the tube is inserted into the damp sand, preferably by twisting the tube as it is inserted, extracting a plug of the moist sand that is driven up into the tube. The tube is then removed from the wet sand and the moist sand plug is removed from the tube. The lower end of the tube is then reinserted into the cavity formed by removal of the sand plug, the lower end of the umbrella support pole is inserted into the upper end of the tube and then clamped thereto. Finally, the excavated area is filled in with dry sand.

The anchoring apparatus effectively increases the width of the support pole's lower end, thereby increasing the static retention strength of the support pole anchorage. The support pole can be effectively inserted deeper into a sand beach than the conventional rocking method by clamping the lower end of the support pole in the upper end of the tubular anchor such that the lower end of the tube extends deeper into the sand than the lower end of the support pole. Because the support pole is effectively embedded deeper into the sand without being rocked back and forth, its anchorage has additional strength.

The above and other objectives, features, and advantages of the present invention will become apparent upon consideration of the detailed description and the appended drawings.

DETAILED DESCRIPTION OF THE INVENTION

Although the present invention is herein described in terms of a specific embodiment, it will be readily apparent to those skilled in this art that various modifications, rearrangements, and substitutions can be made without departing from the spirit of the invention. The scope of the present invention is thus only limited by the claims appended hereto.

Figure 1:
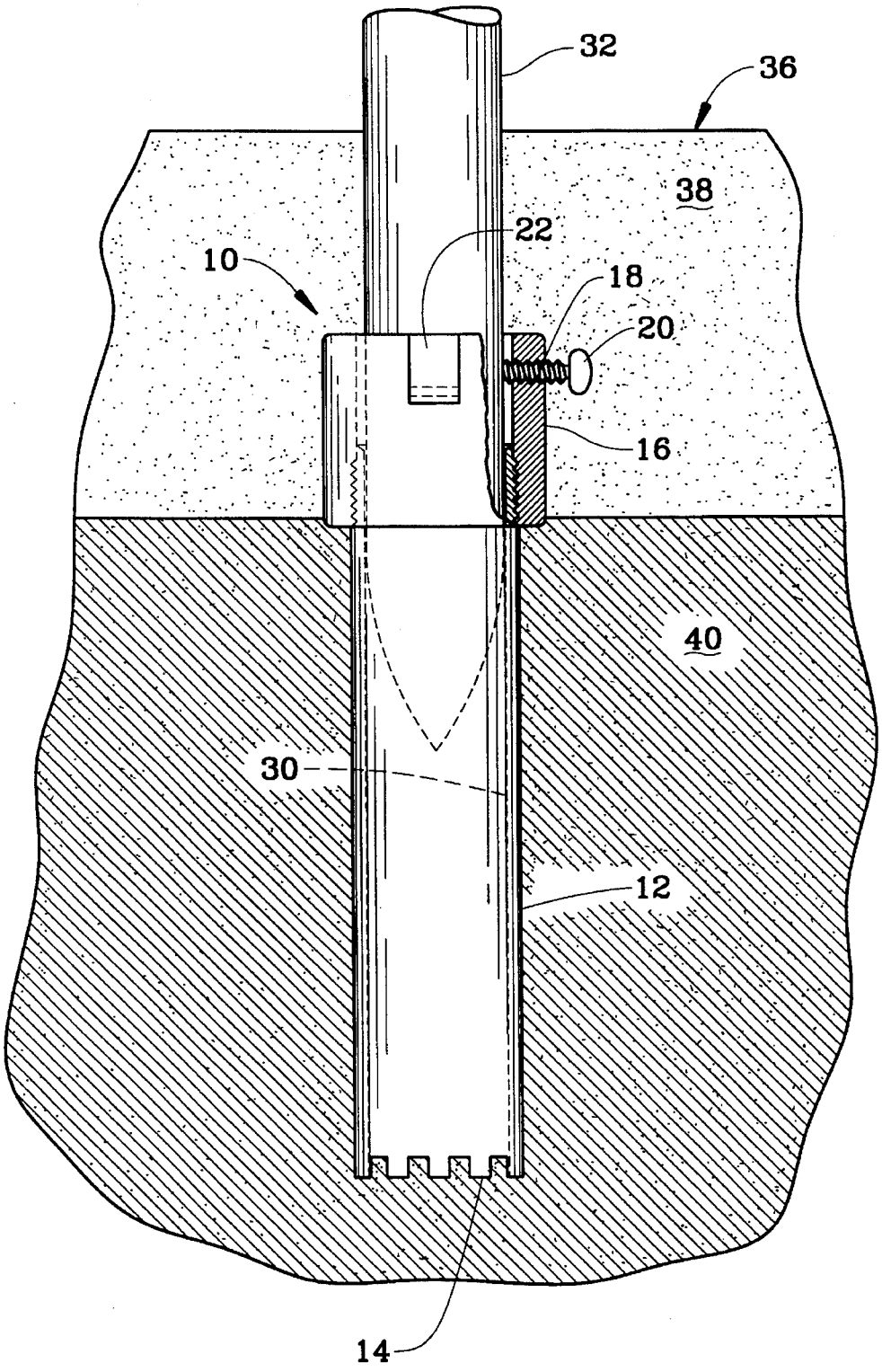
FIG. 1 is a partially sectioned side view of an anchoring apparatus according to the present invention, clamped to the end of a beach umbrella support pole and embedded in a sand beach.
Figure 2:
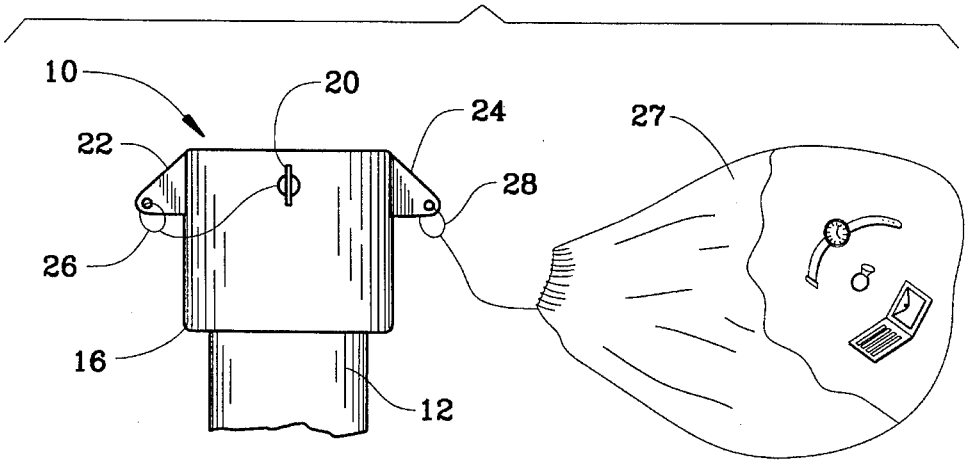
FIG. 2 is a front view of the locking sleeve of the anchoring apparatus of FIG. 1, with its wing bolt and a security pouch tied to its tie brackets.

Referring to FIGS. 1 and 2, one embodiment of a tubular anchoring apparatus 10 according to the present invention includes a tube 12 having a lower end formed with a cutting edge 14 suitable for insertion into damp sand. Cutting edge 14 is preferably serrated which is deemed to include any type of edging that will facilitate the insertion of the tube into wet sand. The other end of tube 12 mounts a locking sleeve 16 forming the upper end of anchoring apparatus 10. Locking sleeve 16 may threadably receive the upper end of tube 12, as shown. It is also envisioned that sleeve 16 and tube 12 may be formed from a single piece of material or joined using any other conventional means, such as an adhesive, welding or the like. In addition, sleeve 16 and tube 12 may be of unitary construction, such as from a metal forming or plastic molding operation.

Locking sleeve 16 is tubular in construction with a threaded bore hole 18 formed through its wall. Bore 18 is operatively adapted to threadably receive the shank of a wing bolt 20 therethrough. Locking sleeve 16 includes at least one and preferably two optional tie brackets 22 and 24. Wing bolt 20 is attached to sleeve 16 such as by a string, wire, or some other form of tie 26 connected to a hole formed through tie bracket 22. As will be discussed in greater detail later on, tie bracket 24 is available for having a security bag 27, such as a draw string pouch, connected thereto also by a tie 28 or other suitable means. Optionally, both the bolt 20 and the pouch 27 could be tied to a single tie bracket. When joined together, tube 12 and sleeve 16 form an inner bore suitable for receiving the lower end of a central support pole 32 of a beach umbrella 34. Anchoring apparatus 10 is used to more firmly anchor the beach umbrella 34 in a sand beach 36. Sand beaches 36 typically have a top layer of relatively dry sand 38 and an underlayer of moist or wet sand 40.

Figure 3A:
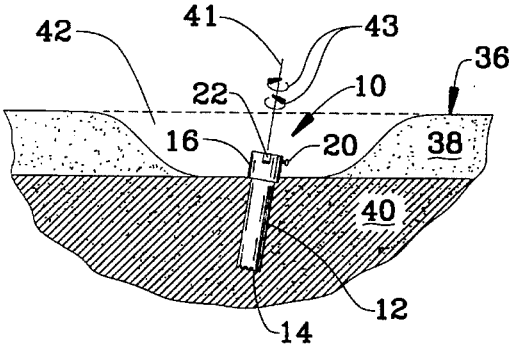
FIGS. 3*a–d* are sectional side views showing the steps of one method for installing the anchoring apparatus of FIG. 1 according to the present invention.
Figure 3B:
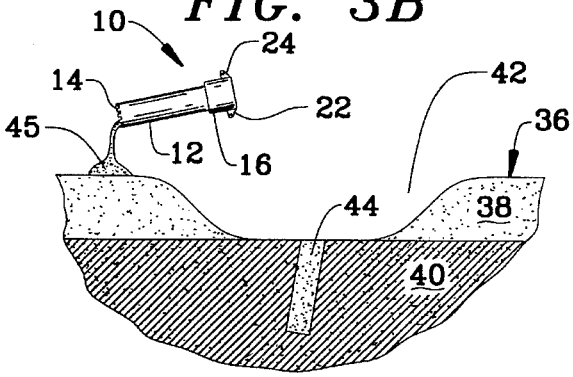
Figure 3C:
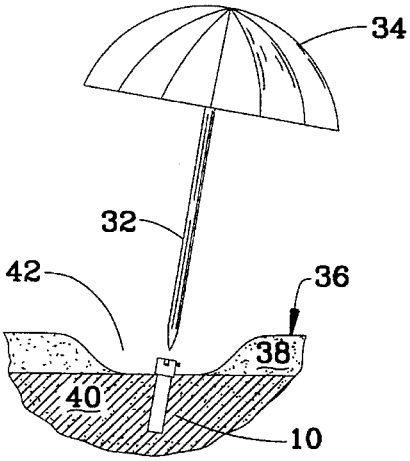
Figure 3D:
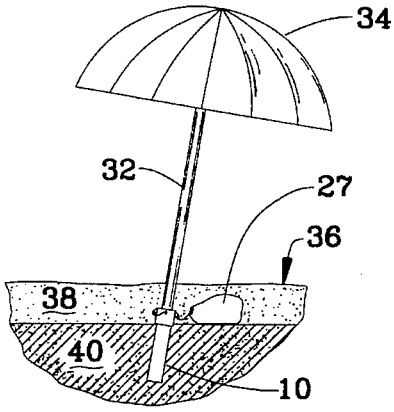

Referring to FIGS. 3*a–d*, one method of anchoring the support pole 32 of a beach umbrella 34 in such a sand beach 36 utilizing the present anchoring apparatus 10 begins with the step of excavating a small area 42 of dry sand 38 to expose the underlayer of wet sand 40. The lower edge 14 of tube 12 is then inserted into wet sand 40, preferably with a twisting action about its central axis 41 as indicated by arrows 43 to more easily cut into sand 40, until tube 12 is completely embedded in wet sand 40. Tie brackets 22 and 24 provide leverage during this twisting operation, making insertion of tube 12 into wet sand 40 easier still. Tube 12 is inserted into sand 40 perpendicular to or at any other angle relative to the surface of beach 36 deemed desirable for the pitch of support pole 32. Referring to FIG. 3*b*, tube 12 is then removed from the wet sand 40 drawing a plug of wet sand 45 with it and leaving behind a blind hole 44. The wet sand 45 in tube 12 is then removed and tube 12 reinserted back into blind hole 44. Referring to FIGS. 3*c* and *d*, with the tube 12 in hole 44, the lower end of support pole 32 is then inserted into the locking sleeve 16 past the wing bolt 20 and preferably into tube 12. Bolt 20 is then tightened until pole 32 is securely clamped in place. At this time, security pouch 27 is connected to tie bracket 24 as described above. Area 42 is then filled-in with dry sand 38 covering both the anchoring apparatus 10 and the security pouch 27. With apparatus 10 clamped to its lower end and buried in this manner, support pole 32 will be harder to dislodge compared to simply inserting pole 32 directly into the sand beach 36. In addition, because it is formed mostly out of the dry sand, area 42 can be excavated by hand, eliminating the need for a shovel or any other digging tool. By covering security pouch 27 with sand 38, its contents are kept secure by being hidden from strangers. At the same time, by being tied to bracket 24, pouch 27 can be quickly located and retrieved by its owner.

The installation of the instant invention can be summarized according to the following steps: brushing aside a small area of dry sand 38 on a beach 36 to reveal the underlying moist sand 40; inserting into the wet sand 40 a tube 12 having a lower end with a lower edge 14 operatively adapted for cutting into the wet sand 40 and an inner bore 30 adapted to receive a support pole 32 from a conventional umbrella 34; extracting a plug of sand by removing the tube 12 from the sand beach, thereby leaving a blind hole 44 therein; inserting the tube 12, lower end first into the blind hole 44 before inserting the support pole 32 in the tube 12, placing a conventional umbrella 34 into the tube 12; clamping an upper end of the tube 12 to the support pole 32 when the support pole is disposed in the inner bore 30; and replacing the dry sand 38 over the underlying moist sand 40. The security pouch 27 can be coupled to the anchoring apparatus 10 before at least completely filling the area 42 with sand.

It should be noted that the device 10 may be incorporated into the support shaft 32 wherein the support shaft 32 may be made to be coupled to the base device 10 by any conventional coupling technique. Variations of this device 10 are obvious to one skilled in the art and deemed within the scope of this invention. In addition to being used to anchor an umbrella 34 in the beach 36, the present anchoring apparatus can be used to secure a tarp, a canopy, a tent or the like. For example, pole 32 could be a stake, made of fiberglass or some other flexible and resilient material, secured in the beach 36 the same way as described above for umbrella 34. The tarp, canopy, tent or the like would then be tied to the stake. If the stake is flexed when tied, the tarp, canopy, tent or the like will be tensioned and stretched by the resiliency of the stake material.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. An anchoring apparatus for securing the central support pole of a conventional beach umbrella in a sand beach, said apparatus comprising: a rigid tube having a sidewall of nominal thickness with a length defined by an upper end and a lower end; said tube forming an inner bore throughout the entire length of said tube; said lower end of said tube having a cutting edge enabling insertion of a portion of said tube into beach sand; said inner bore having a diameter sized to slidably receive a support pole of a conventional beach umbrella, and a tubular locking sleeve mounted to the upper end of said tube, said sleeve having a wall member with a means for locking said sleeve and the support pole of a beach umbrella in a fixed position.

2. The apparatus of claim 1, said locking sleeve having at least one tie bracket formed thereon.

3. The apparatus of claim 1, said locking sleeve having at least one tie bracket having one or the other or both of a finger tightenable bolt capable of being threadably disposed through a threaded hole formed through said wall member so as to lock said sleeve and the support pole of a beach umbrella in a fixed position and a security pouch connected thereto.

4. The apparatus of claim 1, said locking sleeve having two tie brackets formed thereon, said bolt being connected to one tie bracket and a security pouch being connected to the other tie bracket.

5. The apparatus of claim 1, the lower edge of said tube being serrated.

6. The apparatus of claim 1, said locking sleeve being threadably disposed on the other end of said tube.

7. The apparatus of claim 1, said locking sleeve being adhered to the upper end of said tube.

8. The apparatus of claim 1, said locking sleeve and said tube being of single piece construction.

9. A method for anchoring the support pole of a conventional beach umbrella in a sand beach comprising the steps of:

a) brushing aside a small area of dry sand on a beach to reveal underlying moist sand;

b) inserting into the moist sand a rigid tube having a sidewall of nominal thickness with a length defined by an upper end and a lower end; said tube forming an inner bore throughout the entire length of said tube; said lower end of said tube having a cutting edge enabling insertion of a portion of said tube into beach sand; said inner bore having a diameter sized to slidably receive a support pole of a conventional beach umbrella;

c) placing the support pole of a conventional beach umbrella into said inner bore of said tube;

d) securing said tube to the support pole of a conventional beach umbrella when the support pole is positioned in said inner bore; and e) replacing the dry sand over said underlying moist sand.

10. The method of claim 9 including the steps of: extracting a plug of sand by removing the tube from the sand beach, thereby leaving a blind hole therein; and inserting the tube, lower cutting edge first into the blind hole before inserting the support pole in the tube.

11. The method of claim 9 including connecting a security pouch to the anchoring apparatus before at least partially filling the area with sand.

* * * * *